US005598178A

United States Patent [19]

Kawamori

[11] Patent Number: 5,598,178

[45] Date of Patent: Jan. 28, 1997

[54] LIQUID CRYSTAL DISPLAY

[75] Inventor: Hidetsugu Kawamori, Nara, Japan

[73] Assignee: Sharp Kabushiki Kaisha, Osaka, Japan

[21] Appl. No.: 362,144

[22] Filed: Dec. 22, 1994

[30] Foreign Application Priority Data

Dec. 22, 1993 [JP] Japan ..... 5-325126

[51] Int. Cl.[6] ..... G09G 3/36

[52] U.S. Cl. ..... 345/93; 345/58; 345/96; 345/90; 345/100; 345/103

[58] Field of Search ..... 345/93, 96, 90, 345/103, 58, 100

[56] References Cited

U.S. PATENT DOCUMENTS 4,485,380 11/1984 Soneda et al. ..... 345/58
4,743,896 5/1988 Hashimoto et al. ..... 345/87
4,926,168 5/1990 Yamamoto et al. ..... 345/96
5,329,288 7/1994 Kim ..... 345/63

FOREIGN PATENT DOCUMENTS 4-348385 12/1992 Japan .

*Primary Examiner*—Richard Hjerpe
*Assistant Examiner*—Vui T. Tran

[57] ABSTRACT

A liquid crystal display is provided with a dummy-capacity driver for applying dummy capacities to scanning lines, in accordance with the number of on-state display elements and the number of off-state display elements in each scanning line. This arrangement makes it possible to suppress distortions that tend to appear in a waveform of the driving voltage upon inversion of the polarity. Thus, it becomes possible to obtain liquid crystal images of high picture quality with virtually no crosstalk when displaying any pattern.

9 Claims, 13 Drawing Sheets

11
11a
11b
11c
11d
COUNTER
DECODER
Q1 Q2 Q3 Q4
LATCH CIRCUIT
TG
LP
FR
V0
V2
V3
V5
SHIFT REGISTER
2a
2
2b
2c
Y1
Y2
Y3
Y4
Y5-Y(M-1)
YM
D1
D2
D3
D4
10
XN
X(N-1)
X5
X4
X3
X2
X1
1
FROM POWER-SOURCE CIRCUIT
V0
V1
V4
V5
3b
3a
3
SHIFT REGISTER
4
DATA
SCK
LP
FR
FLM
DISPLAY-DATA/TIMING-GENERATION CIRCUIT

FR

WAVEFORMS OF VOLTAGES X2(BROKEN LINE) Y2(SOLID LINE)

WAVEFORMS OF VOLTAGES X3(BROKEN LINE) Y2(SOLID LINE)

WAVEFORMS OF DRIVING VOLTAGES OF (X2, Y2) ELEMENT

WAVEFORMS OF DRIVING VOLTAGES OF (X3, Y2) ELEMENT

FR

WAVEFORMS OF VOLTAGES
X2(BROKEN LINE)
Y2(SOLID LINE)

WAVEFORMS OF VOLTAGES
X3(BROKEN LINE)
Y2(SOLID LINE)

WAVEFORMS OF DRIVING VOLTAGES OF (X2, Y2) ELEMENT

WAVEFORMS OF DRIVING VOLTAGES OF (X3, Y2) ELEMENT

WAVEFORMS OF VOLTAGES X2(BROKEN LINE) Y2(SOLID LINE)

WAVEFORMS OF VOLTAGES X3(BROKEN LINE) Y2(SOLID LINE)

WAVEFORMS OF DRIVING VOLTAGES OF (X2, Y2) ELEMENT

WAVEFORMS OF DRIVING VOLTAGES OF (X3, Y2) ELEMENT

FR

WAVEFORMS OF VOLTAGES X2(BROKEN LINE) Y2(SOLID LINE)

WAVEFORMS OF VOLTAGES X3(BROKEN LINE) Y2(SOLID LINE)

WAVEFORMS OF DRIVING VOLTAGES OF (X2, Y2) ELEMENT

WAVEFORMS OF DRIVING VOLTAGES OF (X3, Y2) ELEMENT

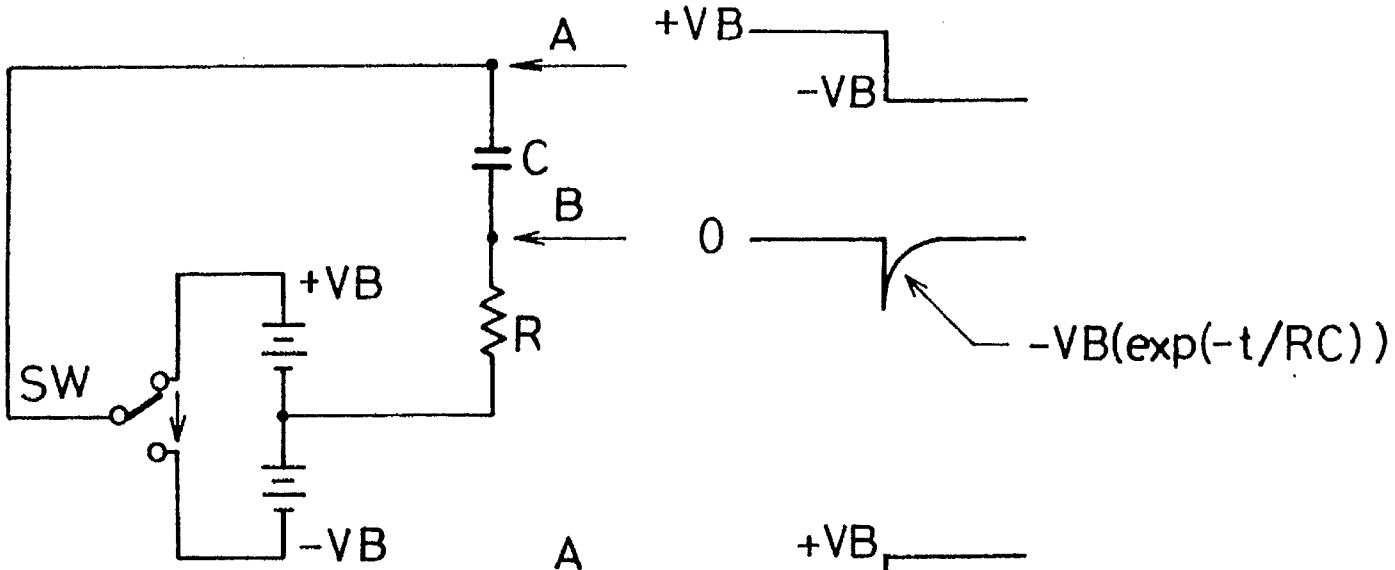
FIG.12(a)FR↑
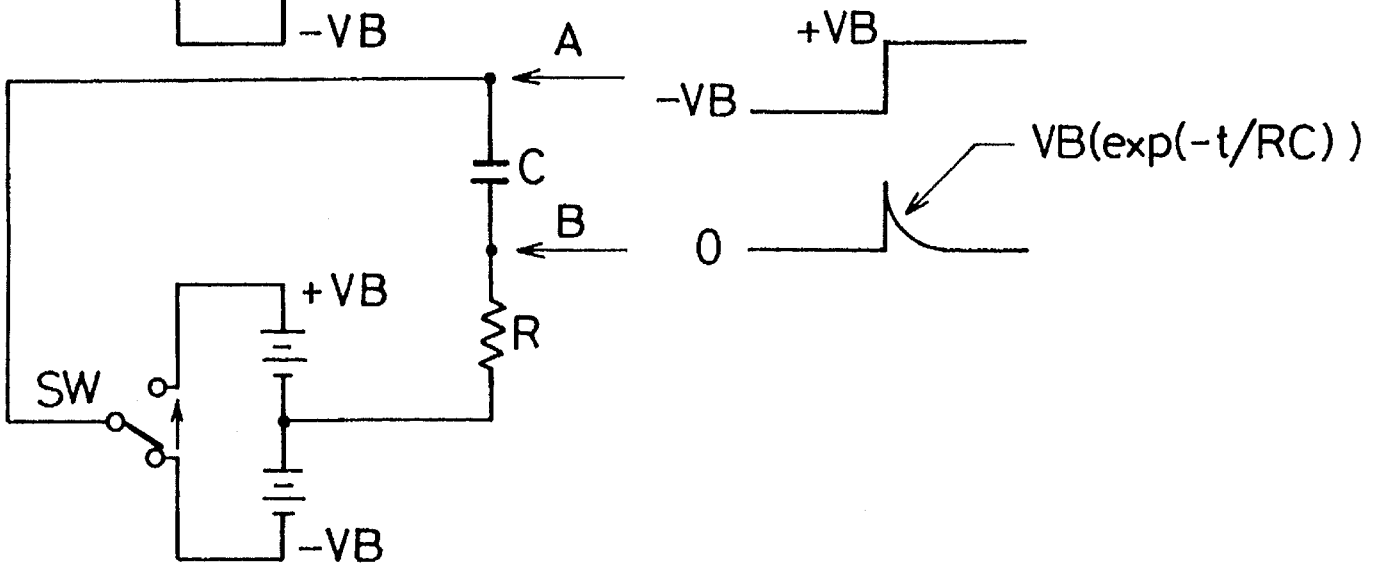
FIG.12(b)FR↓

LIQUID CRYSTAL DISPLAY

FIELD OF THE INVENTION

The present invention relates to liquid crystal displays that are applied to AV(Audio Visual) apparatuses, OA(Office Automation) apparatuses and other apparatuses, and in particular concerns, for example, a simple-matrix-type liquid crystal display having a display screen with a large capacity.

BACKGROUND OF THE INVENTION

Recently, with the developments in information society, liquid crystal displays having a large screen and a large capacity have been widely used. Among these displays, simple-matrix-type liquid crystal displays, which have a simple panel construction and are advantageous in terms of costs, are extensively adopted.

Conventionally, a 1/M-duty simple-matrix-type liquid crystal display with N×M (width×length) dots, shown in FIG. 5, is provided with a liquid crystal display panel 21, a signal-side driver 22 connected to the signal electrodes of the liquid crystal display panel 21, a scanning-side driver 23 connected to the scanning electrodes of the liquid crystal display panel 21, a display-data/timing-generation circuit 24, and a power-source circuit 25 that generates bias voltages of V0 to V5 for use in liquid-crystal driving.

The bias voltages V0 to V5 from the power-source circuit 25 are respectively supplied to transmission gates 22*a* and 23*a* (hereinafter, referred to as TGs) in the signal-side driver 22 and the scanning-side driver 23. Further, in the signal-side driver 22, the following signals, released from the display-data/timing-generation circuit 24, are supplied to respective circuits: a display-data signal DATA and a shift-clock signal SCK are supplied to a shift register 22*c*; a scanning clock signal LP is supplied to a latch circuit 22*b*; and ac-conversion signals FR are supplied to the TGs 22*a*. In the scanning-side driver 23, the following signals, released from the display-data/timing-generation circuit 24, are supplied to respective circuits: a scanning-start signal FLM and the scanning clock signal LP are supplied to a shift register 23*b*; and the ac-conversion signals FR are supplied to the TGs 23*a*.

When these signals are supplied to the signal-side driver 22 as described above, the TGs 22*a* release signal voltages Xn in response to the ac-conversion signals FR and the display-data signal DATA, as is shown in the following truth table in Table 1.

TABLE 1

| FR | DATA | Xn |
|---|---|---|
| 0 | 0 | V2 |
| 1 | 0 | V3 |
| 0 | 1 | V0 |
| 1 | 1 | V5 |

Further, in the scanning-side driver 23, the TGs 23*a* release scanning voltages Ym in response to the ac-conversion signals FR and the scanning-start signal FLM supplied thereto, as is shown in the following truth table in Table 2.

TABLE 2

| FR | FLM | Ym |
|---|---|---|
| 0 | 0 | V1 |
| 1 | 0 | V4 |
| 0 | 1 | V5 |
| 1 | 1 | V0 |

When the signal voltages Xn and the scanning voltages Ym are applied to the respective electrodes, liquid crystal cells, each located at an intersection between the signal-side electrode and the scanning-side electrode, are subjected to the application of driving voltages, each of which corresponds to a difference between the two voltages Xn and Ym.

In accordance with the voltage-averaging method that is known as a driving method used for obtaining an optimal visual discernibility in the above-mentioned simple-matrix-type liquid displays, waveforms of optimal driving voltages, which are used for displaying a black pattern of longitudinal lines in the white background as shown in FIG. 6, are shown in FIGS. 7(*a*) through 7(*e*). Moreover, waveforms of optical driving voltages, which are used for displaying a white pattern of longitudinal lines in the black background as shown in FIG. 8, are shown in FIGS. 9(*a*) through 9(*e*).

In the above-mentioned figures, FIGS. 7(*a*) and 9(*a*) represent the ac-conversion signals to be applied to the respective TGs 22*a* and 23*a*; solid lines in FIGS. 7(*b*) and 9(*b*) represent waveforms of voltages to be applied to the scanning-side electrodes of Y2, while broken lines therein represent waveforms of voltages to be applied to the signal-side electrodes of X2; solid lines in FIGS. 7(*c*) and 9(*c*) represent waveforms of voltages to be applied to the scanning-side electrodes of Y2, while broken lines therein represent waveforms of voltages to be applied to the signal-side electrodes of X3; FIGS. 7(*d*) and 9(*d*) represent waveforms of driving voltages of the (X2, Y2) element; and FIGS. 7(*e*) and 9(*e*) represent waveforms of driving voltages of the (X3, Y2) element. Moreover, in FIG. 6 and FIG. 8, the elements that are indicated by white circles and white squares are on-state elements for white display, and the elements that are indicated by black circles and crosses are off-state elements for black display.

Here, the driving voltage, which is applied across each signal-side electrode and each scanning-side electrode, is subjected to a polarity inversion for each scanning operation corresponding to a predetermined number of lines that is substantially smaller than the number of scanning lines M (in this case, each scanning operation corresponds to 13 lines); thus, the number of switchovers of the driving voltage is not completely dependent on the display pattern.

At this time, assuming that the waveform of the driving voltage of the (X2, Y2) element shown in FIG. 7(*d*) is the same as the waveform of the driving voltage of the (X3, Y2) element shown in FIG. 7(*e*) in an ideal operation, the effective voltage in each element is equal to the on-state voltage (white) that is represented by the following equation:

$$V_{ON} = [\{Vop^2 + (Vop/a)^2 \times (M-1)\}/M]^{1/2} \quad (1)$$
$$= (Vop/a)\{(a^2 + M - 1)/M\}^{1/2}$$

Further, assuming that the waveform of the driving voltage of the (X2, Y2) element shown in FIG. 9(*b*) is the same as the waveform of the driving voltage of the (X3, Y2) element shown in FIG. 9(*c*), the effective voltage in each element is equal to the off-state voltage (black) that is represented by the following equation:

$$V_{OFF} = [\{(1-2Vop/a)^2+(Vop/a)^2\times(M-1)\}/M]^{1/2} \quad (2)$$
$$= (Vop/a)[\{(a-2)^2+M-1\}/M]^{1/2}$$

Here, in the above-mentioned equations (1) and (2), Vop represents a voltage corresponding to the difference between the bias voltages V0 and V5; M represents the number of scanning lines=1/duty ratio. Further, A represents a bias coefficient by which a maximum value of $V_{ON}/V_{OFF}$ is obtained when $a=M^{1/2}+1$.

However, in an actual operation in a conventional liquid crystal display, the waveforms of the driving voltage that are obtained upon displaying a black pattern of longitudinal lines in the white background are indicated by FIGS. 10(*a*) through 10(*e*). Accordingly, in the display pattern shown in FIG. 6, the portions that are indicated by the white squares and that are located on the same signal line as the longitudinal line in the pattern have brightness that is different from the brightness of the other background (indicated by white circles in the drawing). Moreover, in an actual operation, the waveforms of the driving voltage that are obtained upon displaying a white pattern of longitudinal lines in the black background are indicated by FIG. 11. Accordingly, in the display pattern shown in FIG. 8, the portions that are indicated by the crosses have brightness that is different from the brightness of the other background (indicated by black circles in the drawing). This phenomenon, wherein elements having brightness different from that of the background appear on the same signal line as the longitudinal line in the pattern, is referred to as a tailing phenomenon.

As indicated by portions enclosed by circles in FIGS. 10 and 11, the tailing phenomenon is caused by distortions in the waveform of the driving voltage that occur on the scanning lines when the polarity is inverted. In other words, in the display pattern of FIG. 6, due to these distortions in the waveform of the driving voltage, the effective voltages of the (X2, Y2) element and other elements in the background (indicated by white circles) become smaller than those obtained by the equation (1), while the effective voltages of the (X3, Y2) element and other elements in the background (indicated by white squares), which are located on the same signal line as the longitudinal line in the pattern, become greater than those obtained by the equation (1).

Moreover, in the display pattern of FIG. 8, due to these distortions in the waveform of the driving voltage, the effective voltages of the (X2, Y2) element and other elements in the background (indicated by black circles) become smaller than those obtained by the equation (2), while the effective voltages of the (X3, Y2) element and other elements in the background (indicated by crosses), which are located on the same signal line as the longitudinal line in the pattern, become greater than those obtained by the equation (2). In display elements of the negative type wherein on-state elements are displayed as white color, the transmittance commonly becomes higher as the effective voltage increases; therefore, the transmittance of each element is represented by: white square>white circle, and cross>black circle. This phenomenon is recognized as the tailing phenomenon.

The tailing phenomenon, which occurs as described above, is called crosstalk. The crosstalk gives rise to a serious problem to be addressed in the simple-matrix-type liquid crystal display since it extremely lowers the picture quality.

Referring to FIGS. 12 and 13, the following description will discuss a mechanism as to how the distortions occur in the waveform in the voltage to be applied to the scanning lines, upon inversion of the polarity.

In CR-load models as shown in FIGS. 12(*a*) and 12(*b*), it is conventionally well known that when the voltage to be applied to one terminal (A) of C is switched from +VB to −VB or from −VB to +VB, a differential waveform, indicated by each equation in each direction in the drawing, is exerted in the other terminal (B) of C due to the transient phenomenon.

Assuming that the V1 and V4 levels (voltages on the scanning lines that are not selected) are the relative ground level (0 V) and that the signal-line side corresponds to the input terminal, the circuit network, which is made in the liquid crystal display and which starts from the signal-side driver 22 and reaches the V1 and V4 lines (the ground level) through the display elements (C) and the scanning-line electrodes resistors together with the ON resistors (R) in the scanning-side drivers 23, is identical to the models shown in FIGS. 12(*a*) and 12(*b*).

FIGS. 13(*a*) and 13(*b*) show circuit network models, each of which shows some of the elements on the Y2 line in the case of displaying a black pattern in the longitudinal lines in the white background and a differential waveform that is exerted on the Y2 line upon inversion of the polarity. These differential waveforms correspond to the portions enclosed by the circles in FIG. 10. Further, the same explanation is given as to the distortions that are caused upon inversion of the polarity in the case when a white pattern in the longitudinal lines is displayed in the black background.

In the models of FIGS. 12(*a*) and 12(*b*), the differential waveforms, which have different directions due to the different switching directions, assume analogous waveforms. Therefore, in the models having a plurality of parallel capacity loads as shown in FIGS. 13(*a*) and 13(*b*), supposing that Vop and R are constant, the voltage on the scanning-line side is VY, and the voltage on the signal-line side is VX; it is found that the difference $C_X$ between the combined capacity value $C_{ON}$ of the elements that vary from VY<VX to VY>VX and the combined capacity value $C_{OFF}$ of the elements that vary from VY>VX to VY<VX will constitute a factor that determines the effective voltage and direction of the differential waveform.

Here, supposing that the capacity equivalent to one dot of the display element is represented by C, $C_X=(N-2)\cdot C$ holds in the case of the above-mentioned display pattern, since $C_{ON}=(N-1)\cdot C$, as well as $C_{OFF}=C$, holds. Therefore, in conventional liquid crystal displays, crosstalk tends to occur in such a display pattern as $C_X$ has a great value.

SUMMARY OF THE INVENTION

It is an objective of the present invention to provide a liquid crystal display which is capable of displaying images of high quality with virtually no crosstalk in displaying any pattern, by minimizing the difference $C_X$ between the combined capacity value $C_{ON}$ of the elements that vary from VY<VX to VY>VX and the combined capacity value $C_{OFF}$ of the elements that vary from VY>VX to VY<VX, in the case where the voltage on the scanning-line side is represented by VY and the voltage on the signal-line side is represented by VX.

In order to achieve the above-mentioned objective, the liquid crystal display of the present invention is provided with: a plurality of scanning lines to which scanning voltages are successively applied; a plurality of signal lines to which signal voltages in accordance with display data are applied in synchronism with the scanning voltages; and a liquid crystal display element wherein display elements are formed at intersections between the scanning lines and the signal lines. In the liquid crystal display, the display elements are turned on and turned off in accordance with driving voltages for the liquid crystal while the polarity of the driving voltages for the liquid crystal, which are determined by the scanning voltages and the signal voltages, is inverted in predetermined intervals, and a dummy-capacity driver, which adds to each scanning line a dummy capacity corresponding to the number of the on-state display elements and the number of the off-state display elements in the scanning line, is installed.

Supposing that the electric potential of the scanning voltage to be applied to the scanning-line side is VY and that the electric potential of the signal voltage to be applied to the signal-line side is VX, it is preferable to drive the dummy capacity in synchronism with the polarity inversion of the liquid crystal driving voltage so that in the load capacity for each scanning line that consists of the capacity of the display element and the dummy capacity, the capacity value that varies from VY<VX to VY>VX is virtually equal to the capacity value that varies from VY>VX to VY<VX.

In the above-mentioned arrangement, the liquid crystal display is provided with the dummy-capacity driver that adds to each scanning line the dummy capacity corresponding to the number of the on-state display elements and the number of the off-state display elements in each scanning line. In accordance with the number of the on-state display elements and the number of the off-state display elements in each scanning line, the dummy-capacity driver adds the dummy capacity to each scanning line; this makes it possible to suppress distortions that occur in the waveform of the voltage to be applied to each scanning line upon inversion of the polarity. Here, for example, supposing that the electric potential of the scanning voltage to be applied to the scanning-line side is VY and that the electric potential of the signal voltage to be applied to the signal-line side is VX, the dummy capacity is applied in synchronism with the polarity inversion of the liquid crystal driving voltage so that in the load capacity for each scanning line that consists of the capacity of the display element and the dummy capacity, the capacity value that varies from VY<VX to VY>VX is virtually equal to the capacity value that varies from VY>VX to VY<VX. Therefore, it is possible to provide liquid crystal images in high picture quality with virtually no crosstalk in displaying any pattern.

For a fuller understanding of the nature and advantages of the invention, reference should be made to the ensuing detailed description taken in conjunction with the accompanying drawings.

BRIEF DESCRIPTION OF THE DRAWINGS

FIGS. 12(*a*) and 12(*b*) are circuit diagrams that are obtained from the conventional liquid crystal display as a model.

DESCRIPTION OF THE EMBODIMENTS

Figure 1:
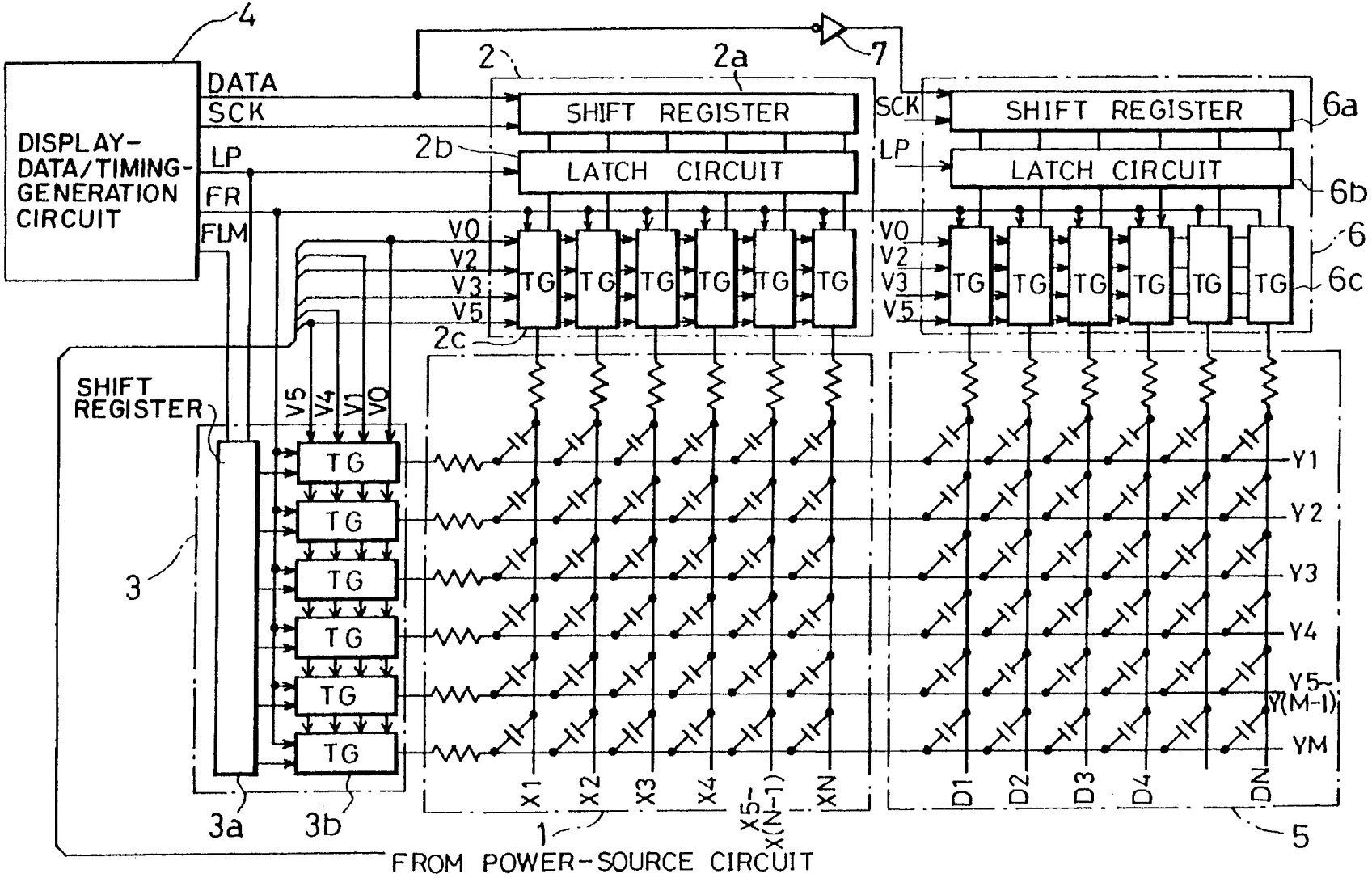
FIG. 1 is a block diagram showing a schematic construction of a liquid crystal display in one embodiment of the present invention.
Figure 2:
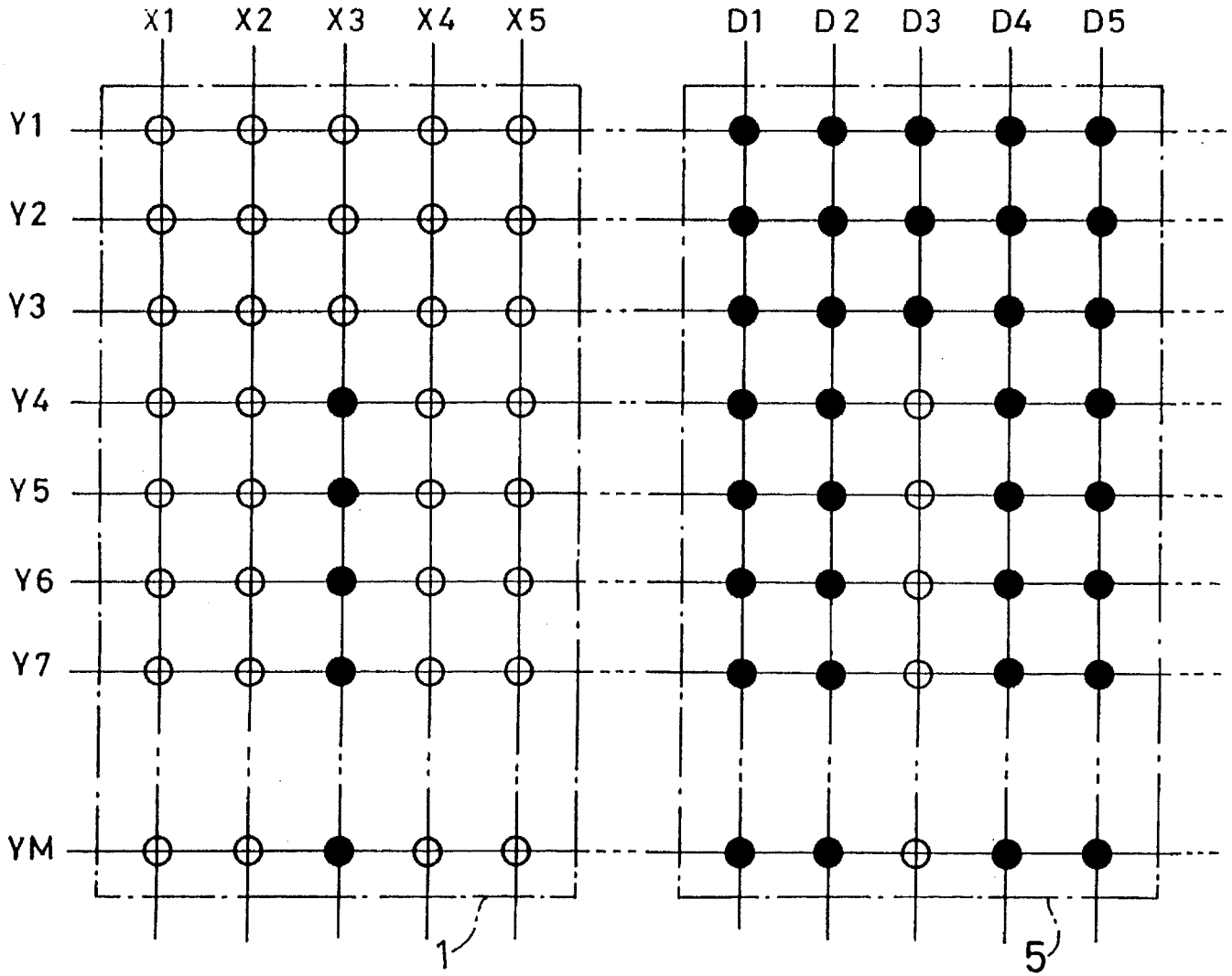
FIG. 2 is a schematic illustration showing one example of a display pattern in the liquid crystal display of FIG. 1.
Figure 3:
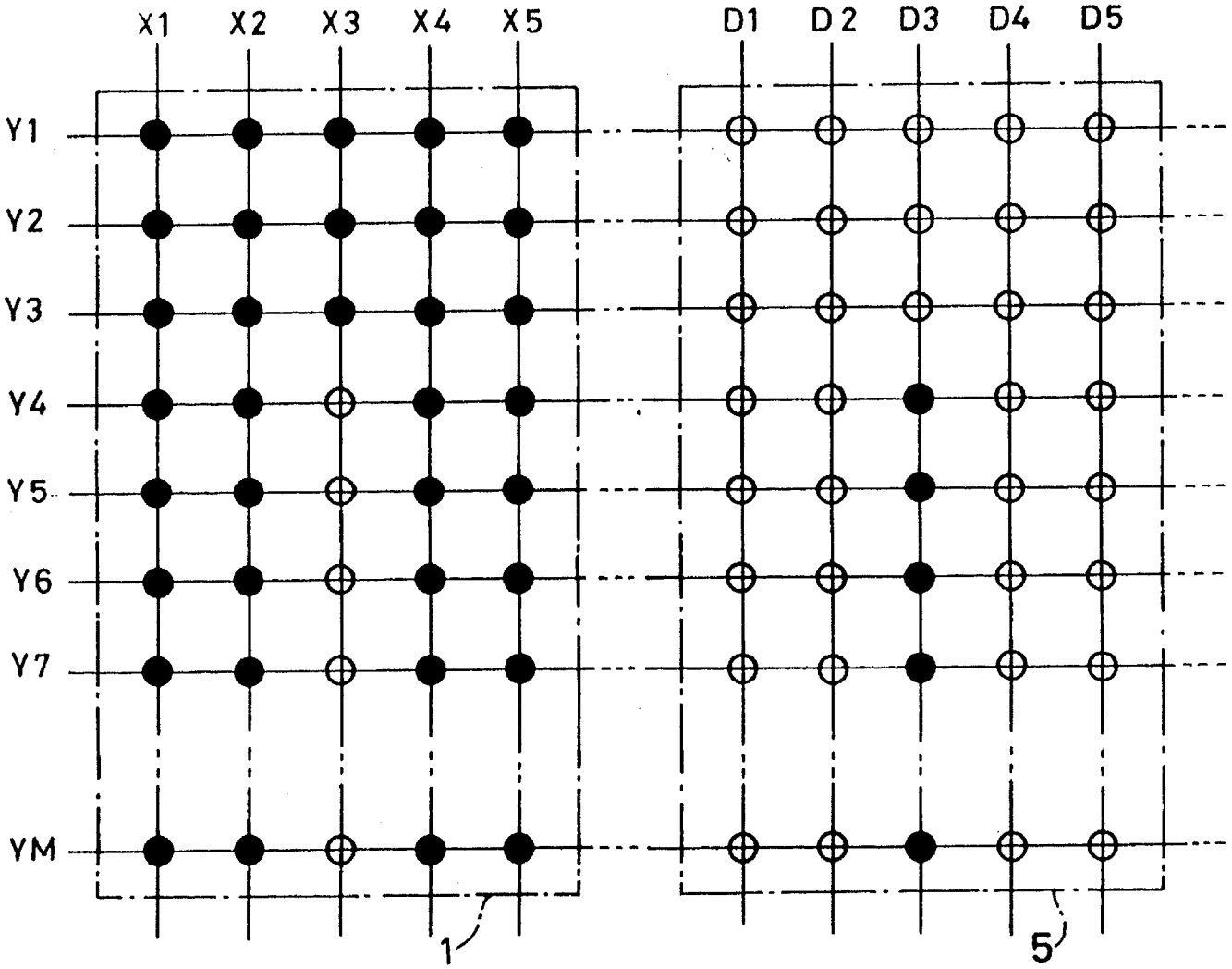
FIG. 3 is a schematic illustration showing another example of a display pattern in the liquid crystal display of FIG. 1.

Referring to FIGS. 1 through 3, the following description will discuss one embodiment of the present invention.

The liquid crystal display of the present embodiment is provided with a liquid crystal display element wherein the first substrate having signal-side electrodes formed thereon and the second substrate having scanning-side electrodes formed thereon are aligned face to face with a liquid crystal layer located in between. This liquid crystal display element is of the 1/M-duty simple-matrix-type with N×M (width× length) dots. As illustrated in FIG. 1, in the liquid crystal display element, an image display section 1 and a dummy capacity section 5 are formed on the same substrate close to each other. On the first substrate, the total 2N lines of signal-side electrodes are formed, that is, 1N lines for image-display use and 1N lines for dummy-capacity use are formed. On the second substrate, M lines of scanning-side electrodes, which are commonly used for the image display section 1 and the dummy capacity section 5, are formed.

The liquid crystal display of the present embodiment is further provided with: a signal-side driver 2 that is connected to the signal-side electrodes of the image display section 1; a dummy capacity driver 6 that is connected to the signal-side electrodes of the dummy capacity section 5; a scanning-side driver 3 that is connected to the scanning-side electrodes; and a display-data/timing-generation circuit 4 that supplies various signals to the signal-side driver 2, the scanning-side driver 3 and the dummy capacity driver 6.

The signal-side driver 2 is constituted of: a shift register 2*a* whereto a display data signal DATA and a shift clock signal SCK, both released from the display-data/timing-generation circuit 4, are inputted; a latch circuit 2*b* whereto a scanning clock signal LP, released from the display-data/timing-generation circuit 4, is inputted; and a plurality of transmission gates 2*c* (hereinafter, referred to as TGs) whereto an ac-conversion signal FR, released from the display-data/timing-generation circuit 4, and bias voltages V0, V2, V3, and V5, supplied from a power source circuit not shown, are inputted. Moreover, the scanning-side driver 3 is constituted of: a shift register 3a whereto a scanning-start signal FLM and the scanning clock LP, both released from the display-data/timing-generation circuit 4, are inputted; and a plurality of TGs 3b whereto the ac-conversion signal FR, released from the display-data/timing-generation circuit 4, and bias voltages V0, V1, V4, and V5, supplied from the power source circuit, are inputted.

Furthermore, the dummy-capacity driver 6 is provided with a shift register 6a, a latch circuit 6b and a plurality of TGs 6c, in the same manner as the signal-side driver 2. Before the shift register 6a, is installed an inverter circuit 7 which inverts the display data signal DATA released from the display-data/timing-generation circuit 4 and inputs it to the shift register 6a. Thus, various signals are inputted to the dummy capacity driver 6 in a parallel relationship with the signal-side driver 2; however, the display data signal DATA inputted to the dummy capacity driver 6 has an inverted relationship with the display data signal DATA inputted to the signal-side driver 2.

In the above-mentioned arrangement, when the display data signal DATA has been accumulated in the shift register 2a inside the signal-side driver 2 by an amount corresponding to one scanning line, the display data signal DATA thus shifted is released to the TGs 2c in response to the scanning clock signal LP. The TGs 2c release signal voltages to the signal-side electrodes in the image display section 1 all at once in a parallel manner, in accordance with the display-data signal DATA and the ac-conversion signal FR that have been inputted thereto. In the scanning-side driver 3, the scanning-start signal FLM is released from the shift register 3a to the TGs 3b in response to the scanning clock signal LP, and the TGs 3b successively release scanning voltages to the scanning-side electrodes in accordance with the scanning-start signal FLM and the ac-conversion FR inputted thereto.

Thus, in the image display section 1, driving voltages, each corresponding to the difference between the signal voltage and the scanning voltage that have been applied to the respective signal-side electrode and scanning-side electrode, are exerted, and liquid crystal cells, which are formed at the intersections at the respective electrodes, are driven, thereby displaying images that correspond to the display data signal DATA.

Moreover, the dummy-capacity driver 6, installed in the liquid crystal display in the present embodiment, also applies signal voltages to the signal-side electrodes in the dummy-capacity section 5 in the same manner as the signal-side driver 2. As described earlier, the display data signal DATA, which has an inverted relationship with the display data signal DATA that has been inputted to the signal-side driver 2, is inputted to the dummy-capacity driver 6 by the inverter circuit 7.

Consequently, the dummy-capacity driver 6 applies signal voltages to the dummy capacity section 5 such that images, which are inverted to the images on the image display section 1 in black and white, are displayed, for example, as shown in FIGS. 2 and 3; thus, the dummy capacities, each having virtually the same capacity as one dot of the display element 1, are applied to each scanning line. The number of the dummy capacities coincides with that of the display elements. Here, FIG. 2 exemplifies a case where a black pattern in longitudinal lines is displayed in the white background, and FIG. 3 exemplifies a case where a white pattern in longitudinal lines is displayed in the black background.

Therefore, in both of the cases of FIGS. 2 and 3, the dummy capacities are applied to each scanning line in accordance with the number of on-state elements (lighted elements) and the number of off-state elements (extinguished elements) in the image display section 1. With this arrangement, supposing that the electric potential on the scanning-line side is VY and the electric potential on the signal-line side is VX, the combined capacity value $C_{ON}$ of the elements wherein the relationship of VY and VX varies from VY<VX to VY>VX upon inversion of the polarity and the combined capacity value $C_{OFF}$ of the elements wherein the relationship varies from VY>VX to VY<VX are made virtually equal to each other. Thus, $|C_{ON}-C_{OFF}|\cong 0$ is achieved for each scanning line independent of displayed patterns.

As described earlier, $|C_{ON}-C_{OFF}|$ forms a factor that determines the effective voltage and direction of the distortions (differential waveform) that occur in the waveform of the voltage that is applied to each scanning line, upon inversion of the polarity. Therefore, the dummy capacities that are obtained in accordance with a display state are applied to the respective scanning lines by using the dummy-capacity driver 6 and the inverter circuit 7; this makes it possible to bring the value of $|C_{ON}-C_{OFF}|$ close to zero, thereby reducing crosstalk and providing liquid crystal images with high picture quality.

Figure 4:
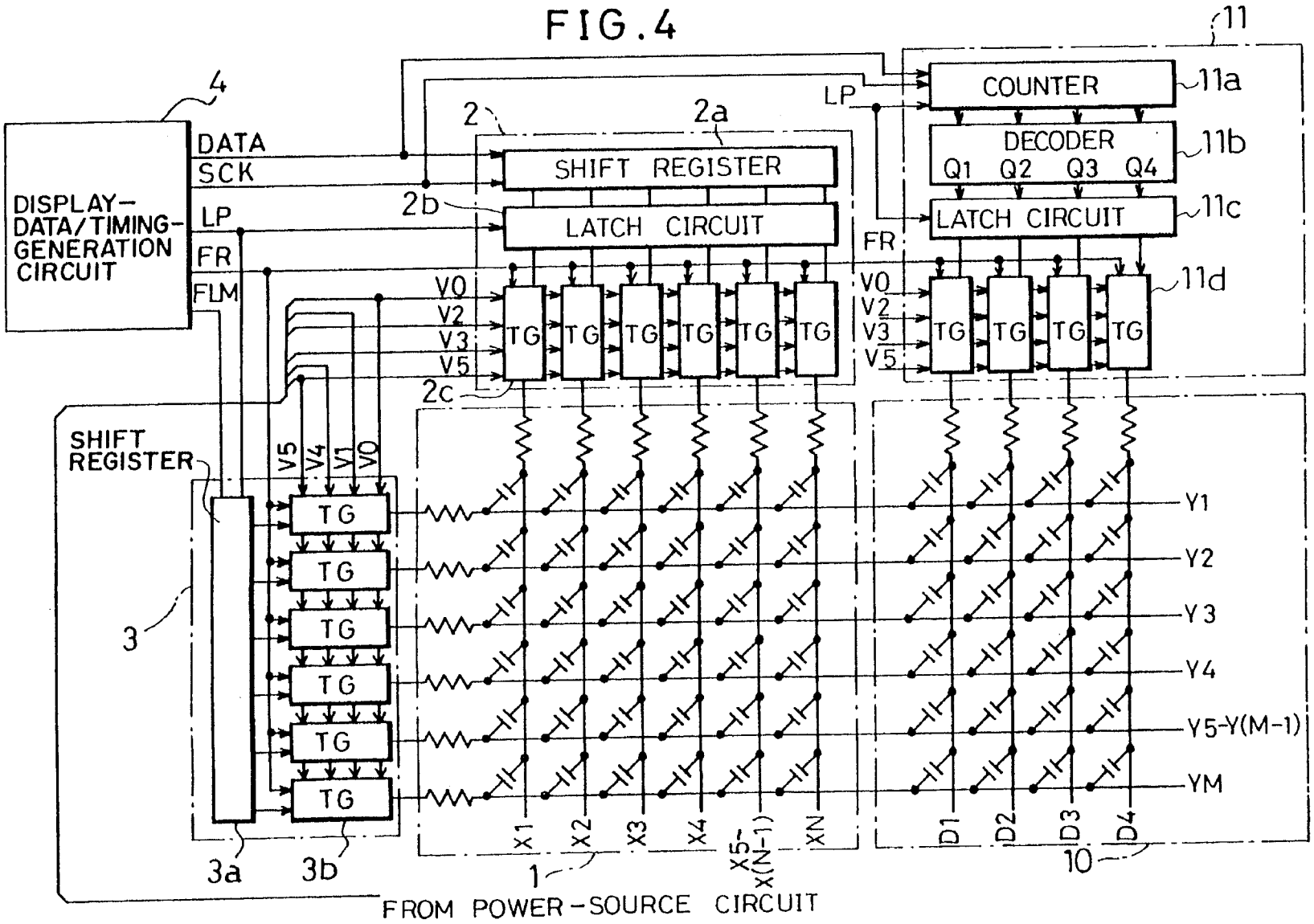
FIG. 4 is a block diagram showing a schematic construction of a liquid crystal display in another embodiment of the present invention.
Figure 5:
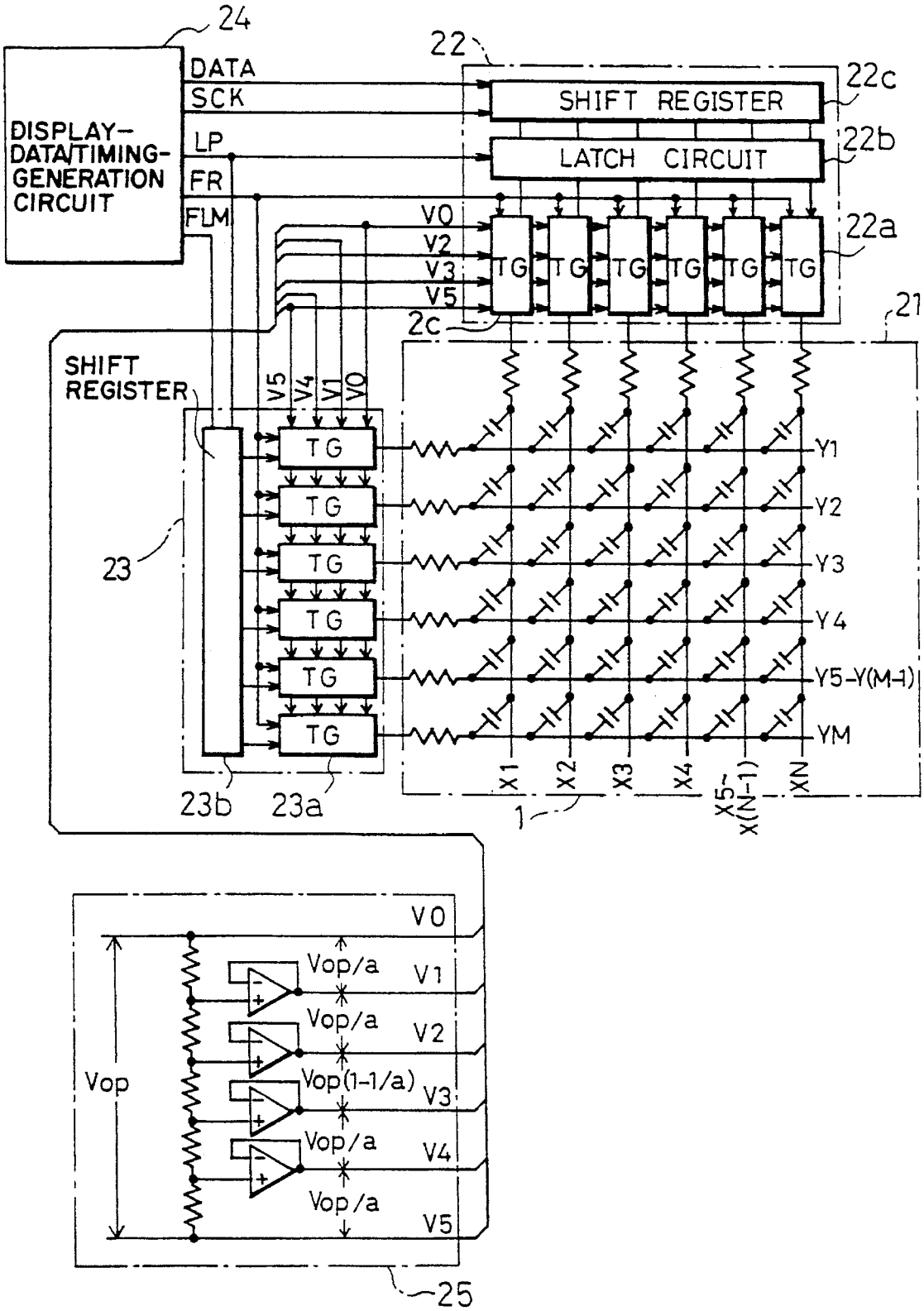
FIG. 5 is a block diagram showing a schematic construction of a conventional liquid crystal display.
Figure 6:
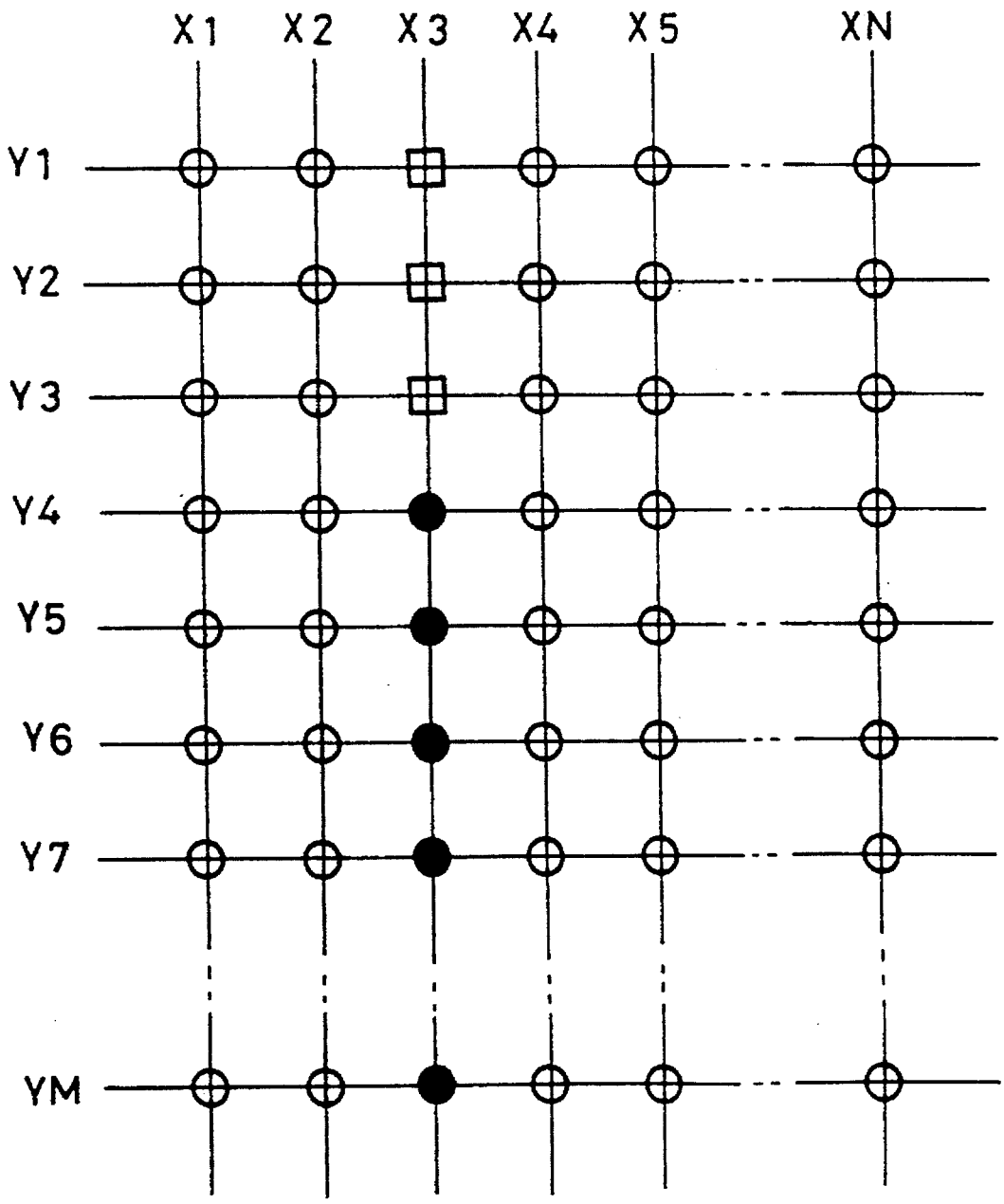
FIG. 6 is a schematic illustration showing one example of a display pattern in the conventional liquid crystal display.
Figure 7A:
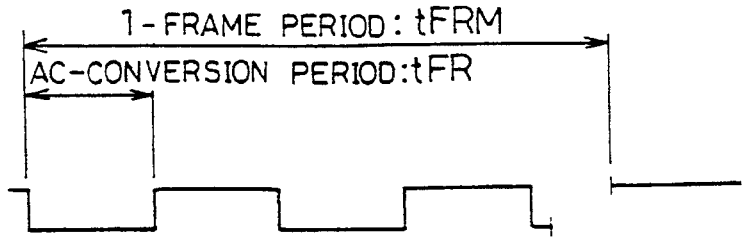
FIGS. 7(*a*) through 7(*e*) are waveform drawings that show optimal signal waveforms in the case of displaying the pattern shown in FIG. 6.
Figure 7B:
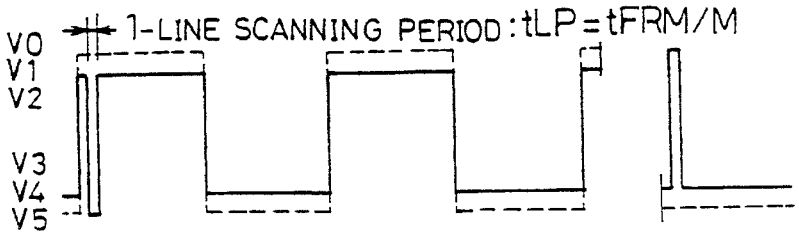
Figure 7C:
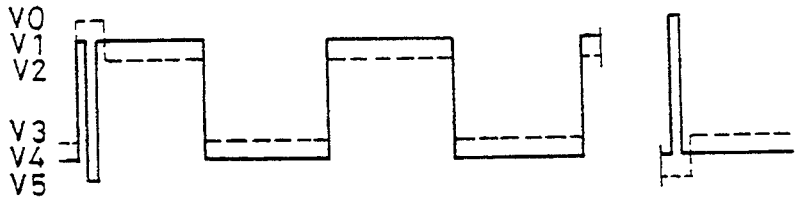
Figure 7D:
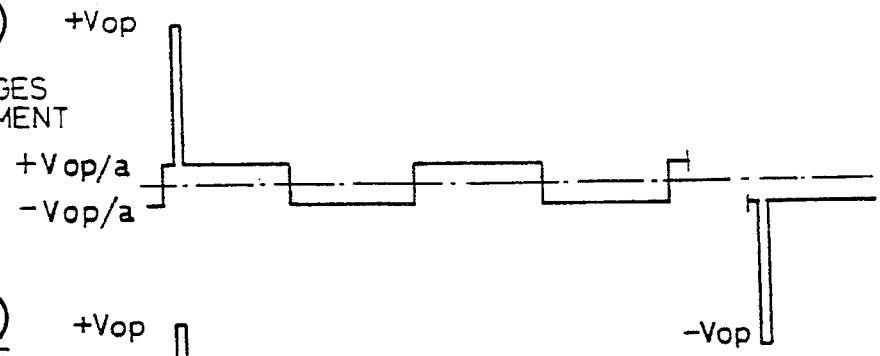
Figure 7E:
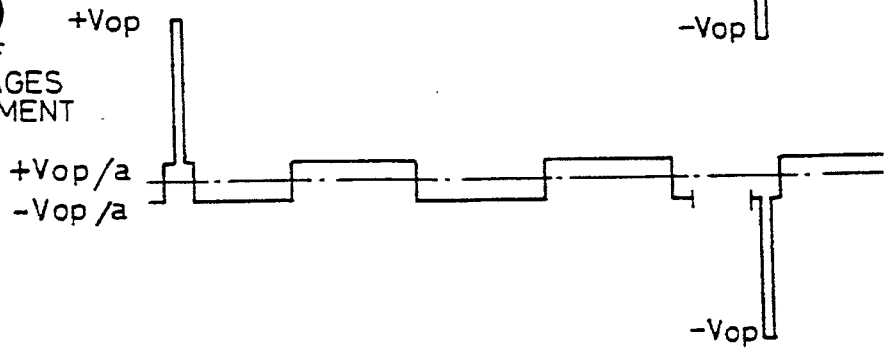
Figure 8:
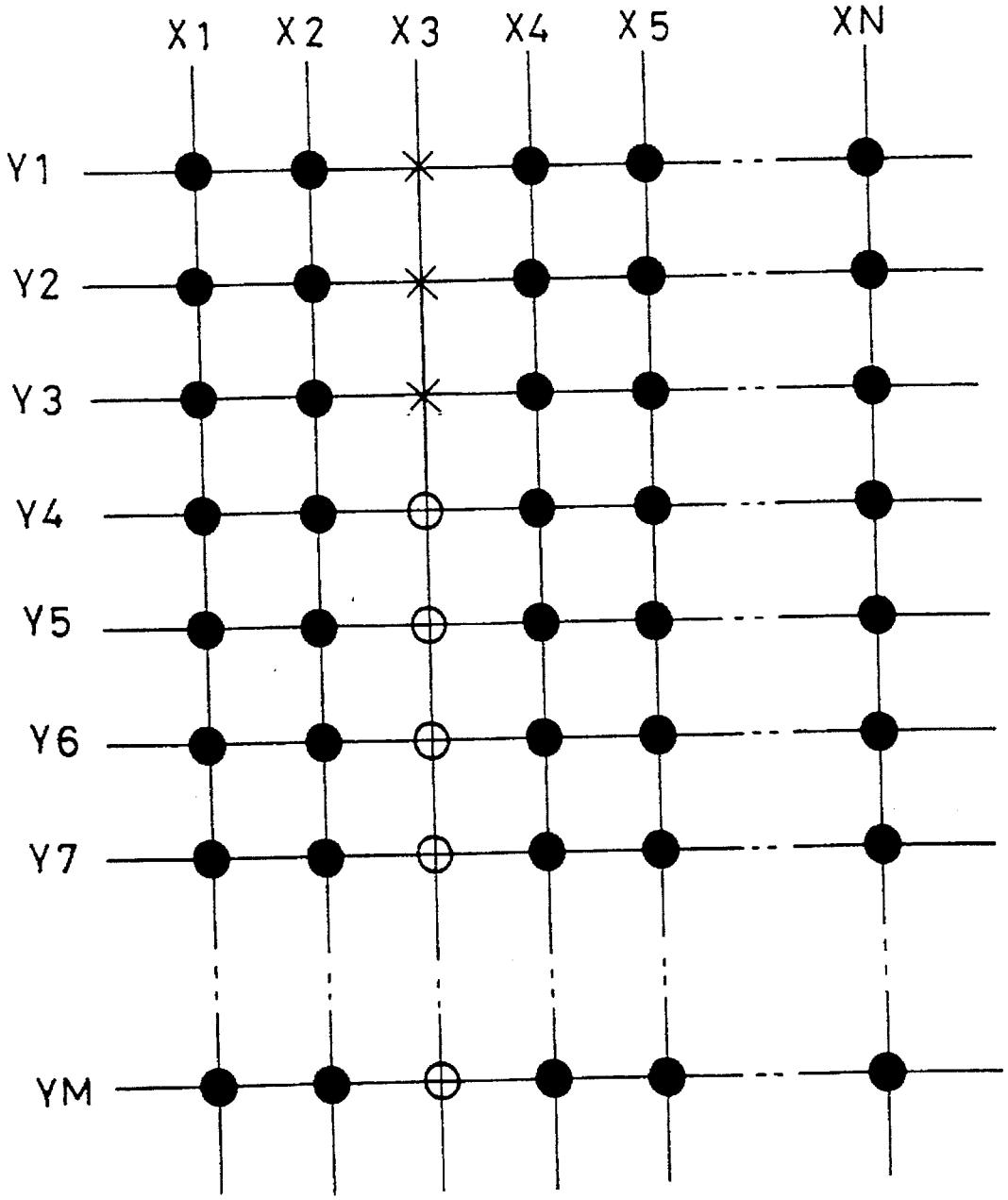
FIG. 8 is a schematic illustration showing one example of a display pattern in the conventional liquid crystal display.
Figure 9A:
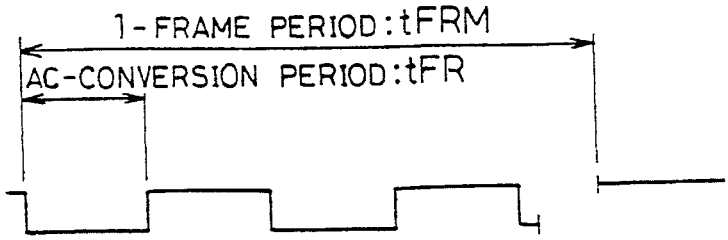
FIGS. 9(*a*) through 9(*e*) are waveform drawings that show optimal signal waveforms in the case of displaying the pattern shown in FIG. 8.
Figure 9B:
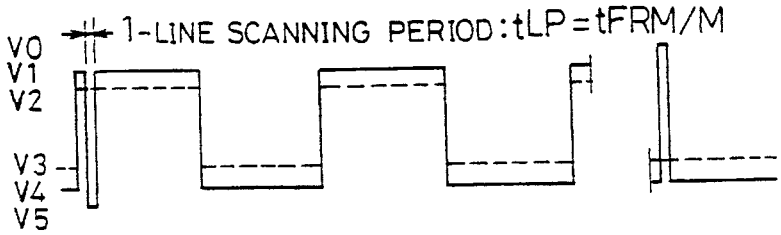
Figure 9C:
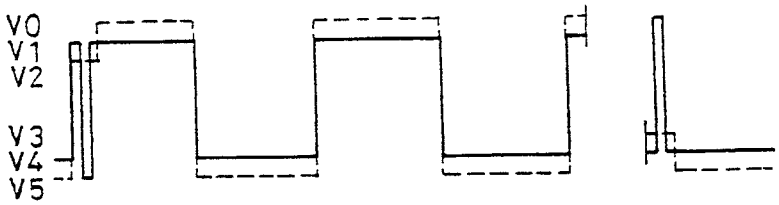
Figure 9D:
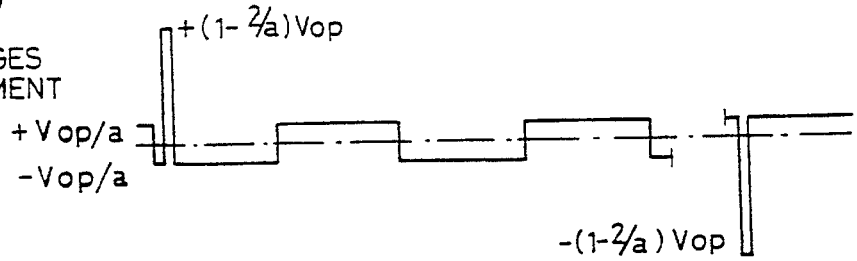
Figure 9E:
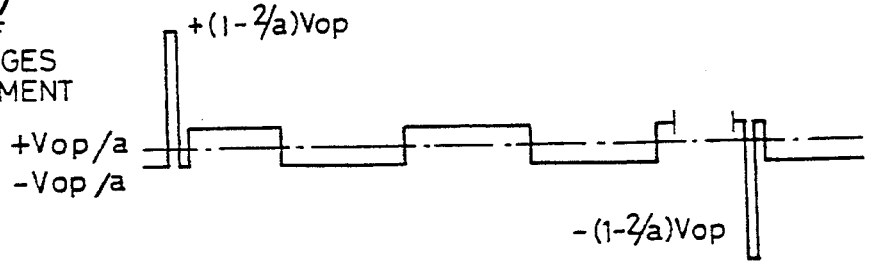
Figure 10A:
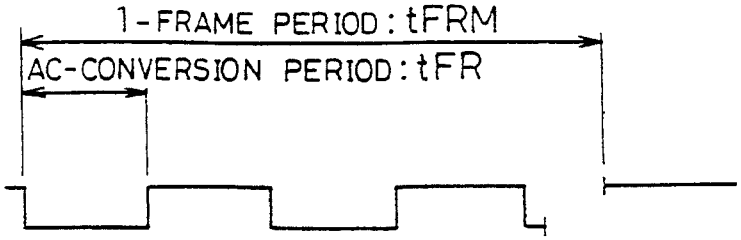
FIGS. 10(*a*) through 10(*e*) are waveform drawings that show actual signal waveforms in the case of displaying the pattern shown in FIG. 6.
Figure 10B:
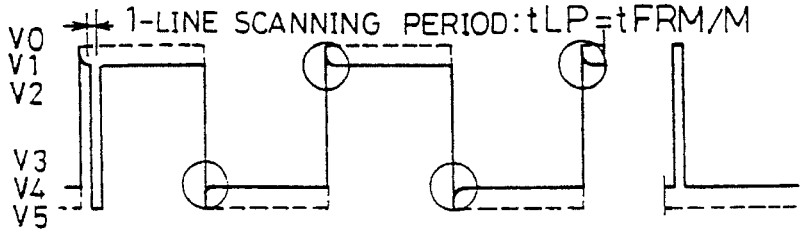
Figure 10C:
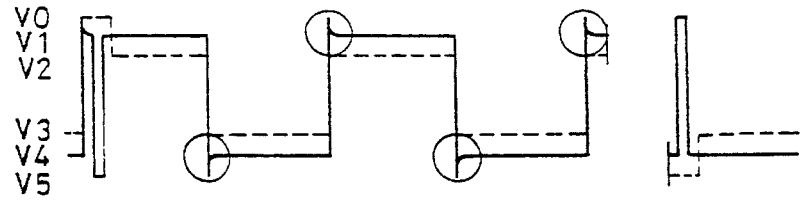
Figure 10D:
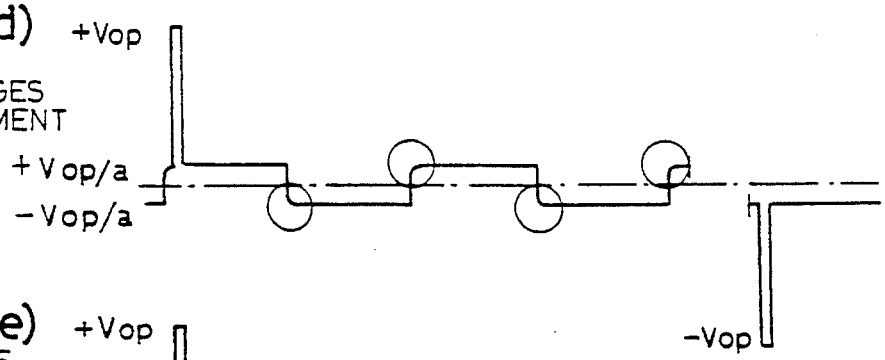
Figure 10E:
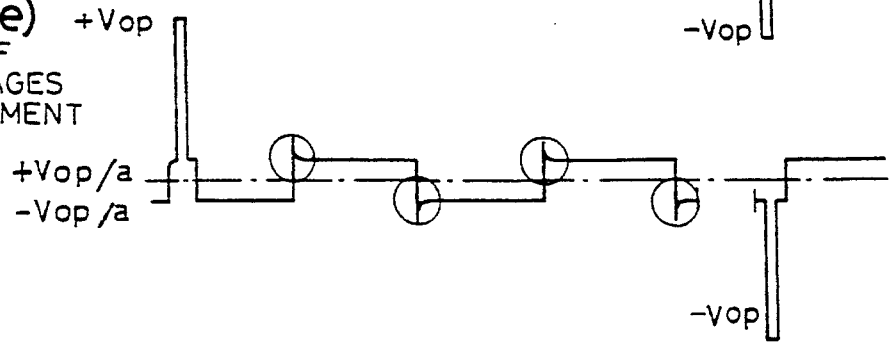
Figure 11A:
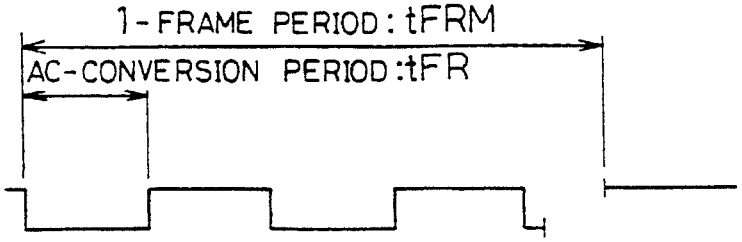
FIGS. 11(*a*) through 11(*e*) are waveform drawings that show actual signal waveforms in the case of displaying the pattern shown in FIG. 8.
Figure 11B:
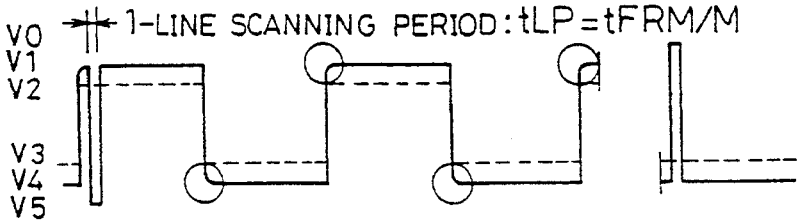
Figure 11C:
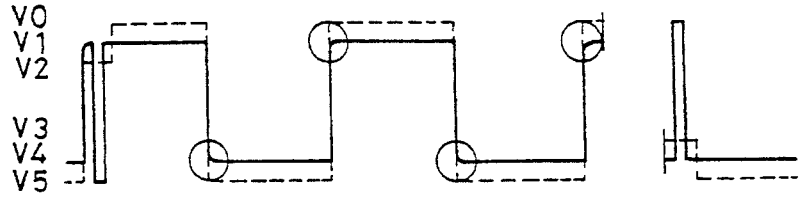
Figure 11D:
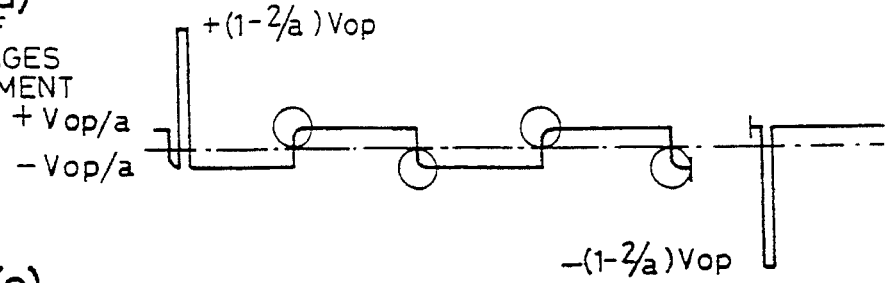
Figure 11E:
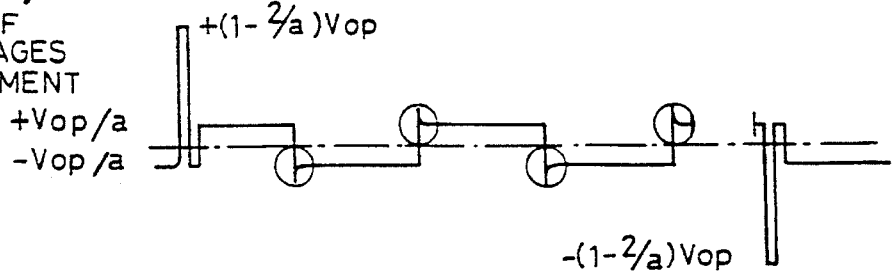
Figure 13A:
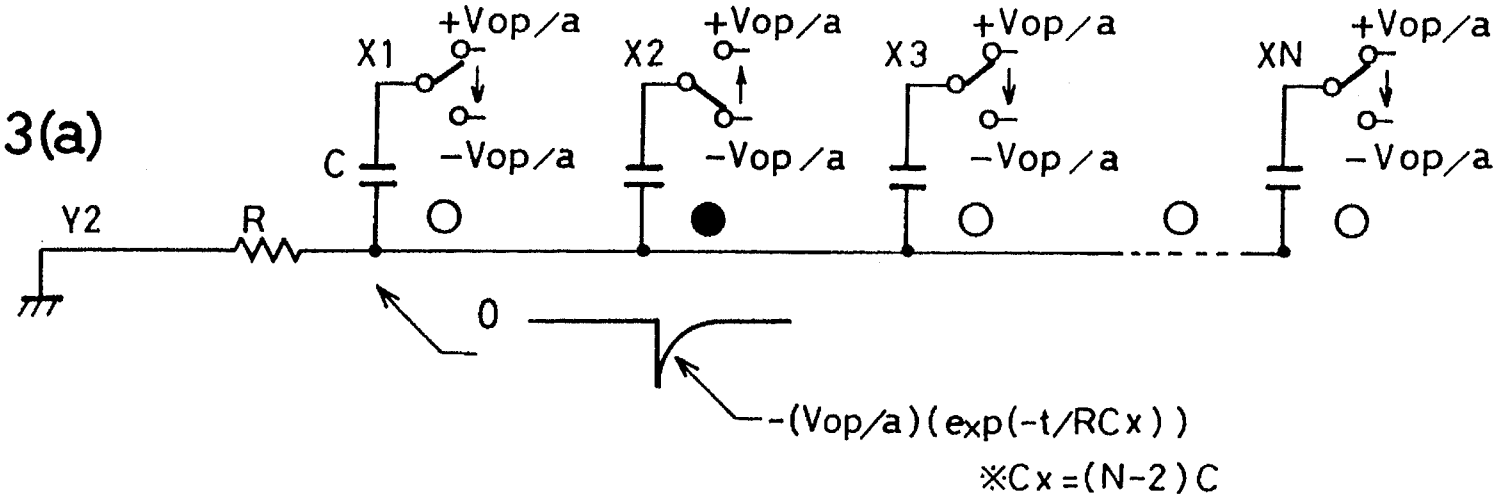
FIGS. 13(*a*) and 13(*b*) are circuit diagrams that are obtained from the scanning lines of the liquid crystal display as a model.
Figure 13B:
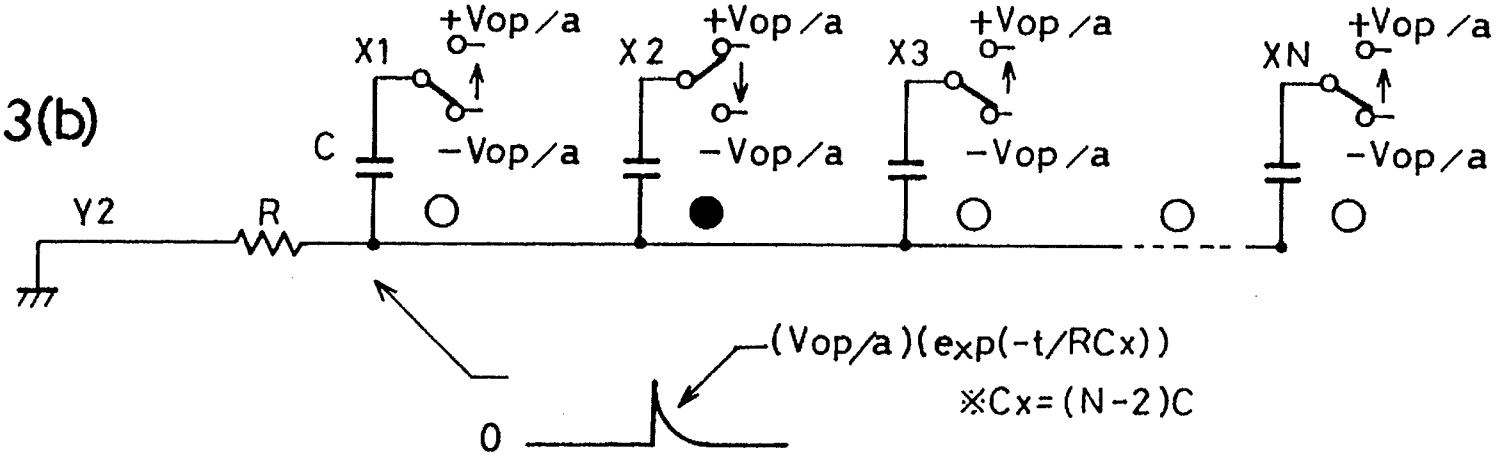

Referring to FIG. 4, the following description will discuss another embodiment of the present invention. Here, for convenience of explanation, those members that have the same functions and that are described in the aforementioned embodiment by reference to the drawings thereof are indicated by the same reference numerals and the description thereof is omitted.

As illustrated in FIG. 4, the liquid crystal display of the present embodiment is provided with a dummy-capacity section 10 that has signal-side electrodes of 4 lines and that is formed close to the image display section 1, in the same manner as the liquid crystal display in accordance with embodiment 1. In the liquid crystal display of the present embodiment, dummy capacities, each having a per-element capacity that is greater than the capacity of one dot of each display element, are applied. The number of the dummy capacities is smaller than that of the display elements (4 lines in this embodiment), and the dummy-capacity section 10 is driven by a dummy-capacity driver 11 having a plurality of TGs 11d, which has the same construction as the signal-side driver 2 in the image display section 1.

The dummy-capacity driver 11, which applies the dummy capacities to the dummy capacity section 10, is provided with: a counter 11a whereto the display data signal DATA, the shift clock signal SCK, the scanning clock signal LP, all of which are released from the display-data/timing-generation circuit 4, are inputted; a decoder 11b for determining the dummy capacities to be applied in accordance with the output of the counter 11a; a latch circuit 11c whereto the scanning clock signal LP, released from the display-data/timing-generation circuit 4, is inputted; and a plurality of TGs 11d whereto the ac-conversion signal FR, released from the display-data/timing-generation circuit 4, and bias voltages V0, V2, V3, and V5, supplied from the power source circuit not shown, are inputted.

Moreover, the display data signal DATA is inputted to the dummy-capacity driver 11 in a parallel relationship with the signal-side driver 2. In the dummy-capacity driver 11, after the counter 11a has calculated how many dots of on-state display data have been inputted among all the N dots in one line, weights are applied to results of the calculation by the decoder 11b, and the resulting weighted data are inputted to the TGs 11d through the latch circuit 11c.

For example, supposing that $N_{ON}$-pieces of on-state display data are inputted to a scanning line including a total of 120 dots, that the capacity corresponding to one dot of the display element is C, and that the dummy-capacity values in the dummy capacity section 10, each corresponding to one element, are respectively 64C for D1 line, 32C for D2 line, 16C for D3 line and 8C for D4 line, the decoder circuit 11*b* provides outputs of 4 bits that are weighted in accordance with the number of $N_{ON}$, as is shown in Table 3.

TABLE 3

| $N_{ON}$ | $CD_{ON} = C_{ON}$ (Dummy Sec) | Q1 | Q2 | Q3 | Q4 |
|---|---|---|---|---|---|
| 113–120 | 8C | OFF | OFF | OFF | ON |
| 105–112 | 16C | OFF | OFF | ON | OFF |
| 97–104 | 24C | OFF | OFF | ON | ON |
| 89–96 | 32C | OFF | ON | OFF | OFF |
| 81–88 | 40C | OFF | ON | OFF | ON |
| 73–80 | 48C | OFF | ON | ON | OFF |
| 65–72 | 56C | OFF | ON | ON | ON |
| 57–64 | 64C | ON | OFF | OFF | OFF |
| 49–56 | 72C | ON | OFF | OFF | ON |
| 41–48 | 80C | ON | OFF | ON | OFF |
| 33–40 | 88C | ON | OFF | ON | ON |
| 25–32 | 96C | ON | ON | OFF | OFF |
| 17–24 | 104C | ON | ON | OFF | ON |
| 9–16 | 112C | ON | ON | ON | OFF |
| 0–8 | 120C | ON | ON | ON | ON |

In this case, the following equations hold:

$$C_{ON}=N_{ON}\cdot C+CD_{ON}, \text{ and}$$

$$C_{OFF}=(120-N_{ON})\cdot C+(64C+32C+16C+8C-CD_{ON})=240C-C_{ON}.$$

Therefore, whatever value $N_{ON}$ may take, $C_{ON}$ and $C_{OFF}$ have virtually the same value; this makes it possible to achieve $|C_{ON}-C_{OFF}|\cong 0$ for each scanning line.

In the above-mentioned arrangement, the dummy-capacity driver 11 is installed so that dummy capacities, each having a per-element capacity that is greater than the capacity of one dot of each display element, are applied not as many as the number of the display elements. Therefore, it is possible to suppress distortions that occur in the waveform of the voltage to be applied to each scanning line upon inversion of the polarity. Consequently, it is possible to provide a liquid crystal display having high picture quality with virtually no crosstalk, independent of patterns to be displayed.

Additionally, in the first and second embodiments, the following dielectric materials may be adopted to form the dummy capacity section in addition to liquid crystal: ceramics, barium titanate, mica, glass, polyester and other materials.

As described above, the liquid crystal display of the present invention is provided with the dummy-capacity driver for applying dummy capacities to scanning lines, in accordance with the number of on-state display elements and the number of off-state display elements in each scanning line. In this case, supposing that the electric potential applied to the scanning-line side is VY and the electric potential applied to the signal-line side is VX, the dummy-capacity driver drives the dummy capacity in synchronism with the polarity inversion of the liquid crystal driving voltage so that in the load capacity for each scanning line that consists of the capacity of the display element and the dummy capacity, the capacity value that varies from VY<VX to VY>VX is virtually equal to the capacity value that varies from VY>VX to VY<VX.

Therefore, the effects obtained by the arrangement are that distortions that tend to occur in the waveform of the voltage to be applied to each scanning line upon inversion of the polarity are suppressed, and that liquid crystal images having high picture quality with virtually no crosstalk are thus obtained in displaying any pattern.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display having a plurality of scanning lines to which scanning voltages are successively applied, a plurality of signal lines to which signal voltages in accordance with display data are applied in synchronism with the scanning voltages, and a liquid crystal display element wherein display elements are formed at intersections between the scanning lines and the signal lines, the display elements being turned on and turned off in accordance with driving voltages for the liquid crystal display while the polarity of the driving voltages for the liquid crystal display, which are determined by the scanning voltages and the signal voltages, is inverted at predetermined intervals, the liquid crystal display comprising:

a dummy-capacity section which has dummy display elements that are formed at intersections between scanning lines and a plurality of dummy-use signal lines to which inverted display data is applied; and dummy-capacity driving means for driving said dummy-capacity section based on the inverted display data.

2. The liquid crystal display as defined in claim 1, wherein said dummy-capacity driving means drives said dummy-capacity section in synchronism with the polarity inversion of the liquid crystal display driving voltage such that an electric potential of each scanning line is VY and an electric potential of each signal line is VX, a combined capacity of the display elements varying from VY<VX to VY>VX being virtually equal to the combined capacity of the display elements varying from VY>VX to VY<VX in a load capacity for each scanning line that consists of capacity of the display elements and the dummy display elements.

3. The liquid crystal display as defined in claim 1, wherein said dummy-capacity section adds capacitors of a plurality of kinds to each scanning line as dummy capacity, a number of the capacitors being smaller than a total number of the display elements of the scanning line, each capacitor having an electrostatic capacity greater than that of a display element.

4. The liquid crystal display as defined in claim 3, wherein said dummy-capacity driving means comprises:

storing means for storing display data corresponding to one scanning line;

detection means for detecting a number of display elements that are turned on in each scanning line in accordance with the display data stored in said storing means; and means for determining the capacitors to be added to each line in accordance with the number of display elements detected by said detection means and for driving the added capacitors.

5. A liquid crystal display comprising:

a liquid crystal display element having a plurality of scanning lines to which scanning voltages are successively applied and a plurality of signal lines to which first signal voltages in accordance with display data are applied in synchronism with the scanning voltages, said liquid crystal display element being provided with display elements that are formed at intersections between the scanning lines and the signal lines;

inversion means for inverting the display data;

driving means for driving the display elements so that they are turned on and turned off in accordance with first liquid crystal driving voltages while polarity of the first liquid crystal driving voltages are inverted at predetermined intervals, the first liquid crystal driving voltages being determined by the scanning voltages and the first signal voltages;

a dummy-capacity section which has dummy display elements that are formed at intersections between scanning lines and a plurality of dummy-use signal lines to which second signal voltages are applied in response to the output of said inverting means in synchronism with the scanning voltages; and dummy-capacity driving means for driving the dummy display elements in accordance with second liquid crystal driving voltages while polarity of the second liquid crystal driving voltages are inverted at predetermined intervals, the second liquid crystal driving voltages being determined by the scanning voltages and the second signal voltages.

6. The liquid crystal display as defined in claim 5, wherein a total number of the dummy display elements in said dummy-capacity section is equal to a total number of the display elements in said liquid crystal display element, an electrostatic capacity of each dummy display element being equal to that of a display element.

7. A liquid crystal display comprising:

a liquid crystal display element having a plurality of scanning lines to which scanning voltages are successively applied and a plurality of signal lines to which first signal voltages in accordance with display data are applied in synchronism with the scanning voltages, said liquid crystal display element being provided with display elements that are formed at intersections between the scanning lines and the signal lines;

driving means for driving the display elements so that they are turned on and turned off in accordance with first liquid crystal driving voltages while polarity of the first liquid crystal driving voltages are inverted at predetermined intervals, the first liquid crystal driving voltages being determined by the scanning voltages and the first signal voltages;

detection means for detecting a number of display elements that are turned on in each scanning line;

a dummy-capacity section which has dummy display elements that are formed at intersections between scanning lines and a plurality of dummy-use signal lines to which second signal voltages are applied in response to the number of display elements detected by said detection means in synchronism with the scanning voltages; and dummy-capacity driving means for driving the dummy display elements in accordance with second liquid crystal driving voltages while polarity of the second liquid crystal driving voltages are inverted at predetermined intervals, the second liquid crystal driving voltages being determined by the scanning voltages and the second signal voltages.

8. The liquid crystal display as defined in claim 7, wherein said dummy-capacity section comprises dummy display elements of a plurality of kinds, a number of the dummy display elements being smaller than a total number of the display elements of each scanning line, each dummy display element having an electrostatic capacity greater than that of a display element, a sum of the electrostatic capacities of the dummy display elements in each line being virtually equal to a sum of the electrostatic capacities of all the display elements in the corresponding scanning line in said liquid crystal display element.

9. The liquid crystal display as defined in claim 8, wherein said dummy-capacity driving means further comprises means for determining the dummy display elements to be added to each line in accordance with the number of display elements detected by said detection means and for driving the added dummy display elements.

* * * * *